US007789923B2

(12) United States Patent
Oh et al.

(10) Patent No.: US 7,789,923 B2
(45) Date of Patent: Sep. 7, 2010

(54) DUST-COLLECTING APPARATUS OF A VACUUM CLEANER

(75) Inventors: Jang-keun Oh, Gwangiu (KR); Seung-yong Cha, Busan (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 523 days.

(21) Appl. No.: 11/882,268

(22) Filed: Jul. 31, 2007

(65) Prior Publication Data

US 2008/0184680 A1 Aug. 7, 2008

(30) Foreign Application Priority Data

Feb. 5, 2007 (KR) ..... 10-2007-0011674

(51) Int. Cl.
*B01D 45/12* (2006.01)

(52) U.S. Cl. ..... 55/343; 55/349; 55/429; 55/459.1; 55/DIG. 3

(58) Field of Classification Search ..... 55/343, 55/346, 349, 429, 459.1, DIG. 3
See application file for complete search history.

(56) References Cited

U.S. PATENT DOCUMENTS 6,502,277 B1 * 1/2003 Petersson et al. ..... 15/352
6,746,500 B1 6/2004 Park et al.
6,840,972 B1 1/2005 Kim
2005/0252179 A1 11/2005 Oh et al.
2006/0107629 A1 5/2006 Oh
2007/0151071 A1 7/2007 Son et al.

FOREIGN PATENT DOCUMENTS

| | | |
|---|---|---|
| EP | 1683462 A1 | 7/2006 |
| FR | 2878144 | 5/2006 |
| GB | 2344778 | 6/2000 |
| JP | 59-130559 | 7/1984 |
| JP | 2004-121722 | 4/2004 |
| KR | 10-2002-0071622 | 9/2002 |
| KR | 2002 0071625 | 9/2002 |
| KR | 100629601 | 9/2006 |
| RU | 2286079 | 7/2006 |
| WO | WO 2004/049889 | 6/2004 |

* cited by examiner

*Primary Examiner*—Robert A Hopkins
(74) *Attorney, Agent, or Firm*—Blank Rome LLP

(57) ABSTRACT

A dust-collecting apparatus of a vacuum cleaner includes a first dust-collecting unit, a second dust-collecting unit, and a dust receptacle. The second dust-collecting unit is adapted to be mounted to one side of the first dust-collecting unit. The dust receptacle is adapted to be mounted on a lower part of both the first and the second dust-collecting units, and the dust receptacle is adapted to store dust separated by the first and the second dust-collecting units. The first and second dust-collecting units are arranged so that air discharged from the first dust-collecting unit enters the second dust-collecting unit.

12 Claims, 5 Drawing Sheets

DUST-COLLECTING APPARATUS OF A VACUUM CLEANER

CROSS-REFERENCES TO RELATED APPLICATIONS

This application claims priority under 35 U.S.C. §119 from Korean Patent Application No. 10-2007-0011674, filed on Feb. 5, 2007, in the Korean Intellectual Property Office, the disclosure of which is incorporated herein by reference in its entirety.

This application may be related to the copending U.S. patent application Ser. No. 10/840,231, filed May 7, 2004 entitled "Cyclone Dust Separating Apparatus and Vacuum Cleaner Having the Same" by Jang-Keun Oh et al., the entire disclosure of which is incorporated herein by reference.

This application may be related to the copending U.S. patent application Ser. No. 10/851,114, filed May 24, 2004 entitled "Cyclone Dust Collecting Device for Vacuum Cleaner" by Jang-Keun Oh et al., the entire disclosure of which is incorporated herein by reference.

This application may be related to the copending U.S. patent application Ser. No. 10/874,257, filed Jun. 24, 2004 entitled "Cyclone Dust Collecting Apparatus for a Vacuum Cleaner" by Jang-Keun Oh et al., the entire disclosure of which is incorporated herein by reference.

This application may be related to the copending U.S. patent application Ser. No. 11/137,506, filed May 26, 2005 entitled "Vacuum Cleaner Dust Collecting Apparatus" by Jung-Gyun Han et al., the entire disclosure of which is incorporated herein by reference.

This application may be related to the copending U.S. patent application Ser. No. 11/206,878, filed Aug. 19, 2005 entitled "Dust Collecting Apparatus of a Vacuum Cleaner" by Ji-Won Seo et al., the entire disclosure of which is incorporated herein by reference.

This application may be related to the copending U.S. patent application Ser. No. 11/203,990, filed Aug. 16, 2005 entitled "Dust-Collecting Apparatus and Method for a Vacuum Cleaner" by Ji-Won Seo et al., the entire disclosure of which is incorporated herein by reference.

This application may be related to the copending U.S. patent application Ser. No. 11/281,732, filed Nov. 18, 2005 entitled "Dust Collecting Apparatus for a Vacuum Cleaner" by Jung-Gyun Han et al., the entire disclosure of which is incorporated herein by reference.

This application may be related to the copending U.S. patent application Ser. No. 11/315,335, filed Dec. 23, 2005 entitled "Multi-Cyclone Dust Separating Apparatus" by Dong-Yun Lee et al., the entire disclosure of which is incorporated herein by reference.

This application may be related to the U.S. Pat. No. 7,097,680, granted Aug. 29, 2006 entitled "Cyclone Separating Apparatus and Vacuum Cleaner Equipped with the Same" by Jang-Keun Oh, the entire disclosure of which is incorporated herein by reference.

FIELD OF THE INVENTION

The present invention relates to a vacuum cleaner. More particularly, the present invention relates to a dust-collecting apparatus for a vacuum cleaner.

BACKGROUND OF THE INVENTION

A conventional dust-collecting apparatus of a vacuum cleaner draws in air laden with dust and separates the dust from the air. The term "dust" will be used herein to refer collectively to dust, dirt, particulates, debris, contaminants, and other similar matter that can be entrained with the air suctioned by the vacuum cleaner. The conventional dust-collecting apparatus has become widely used because it can be used without the inconvenience of frequently replacing a dust bag.

The conventional dust-collecting apparatus may typically comprise a filter through which air laden with dust passes to separate the dust from the air and a cyclone dust-collecting apparatus which whirls air laden with dust and separates the dust from the air using centrifugal force.

As disclosed in Korean Patent Publication No. 412,583, the conventional cyclone dust-collecting apparatus usually has a cyclone unit vertically installed, a cyclone body with an air inlet formed on its side, an air outlet formed on its top, and a dust receptacle connected to a bottom part of the cyclone unit. Accordingly, external air and dust are drawn in through the side of the cyclone body, and the air swirls in a downward direction in the cyclone body. The dust is removed from the air and collected in the dust receptacle. However, such a conventional cyclone dust-collecting apparatus requires the dust receptacle to be relatively small. As a result, the conventional cyclone dust-collecting apparatus is inconvenient to use because the dust receptacle needs to be dumped frequently. Furthermore, because air swirls and moves in the same direction in which dust falls, the dust collected in the dust receptacle is entrained by the swirling air and flows back from a first dust-collecting chamber.

In addition, U.S. Pat. No. 6,350,292 discloses a cyclone dust-collecting apparatus, in which a dust-collecting unit and a dust receptacle are mounted at right angles so that air swirls and moves in a direction different from the direction in which dust falls in order to prevent the dust from flowing back. However, the dust-collecting apparatus has a large volume and the dust-separating efficiency is low.

SUMMARY OF THE INVENTION

An aspect of the present disclosure is to address at least the above problems and/or disadvantages and to provide at least the advantages described below. Accordingly, an aspect of the present disclosure is to provide a dust-collecting apparatus of a vacuum cleaner in which dust is prevented from flowing back, dust-collecting efficiency is improved, and capacity for holding dust is increased without increasing the volume of the dust-collecting apparatus.

One embodiment of the present invention provides a dust-collecting apparatus of a vacuum cleaner. The dust-collecting apparatus of a vacuum cleaner includes a first dust-collecting unit which rotates air laden with dust and separates the dust from the air; a second dust-collecting unit which is mounted on one side of the first dust-collecting unit; and a dust receptacle which stores the dust separated by the first and the second dust-collecting units, the dust receptacle being mounted on a lower part of both the first and the second dust-collecting units, wherein at least one of the first and second dust-collecting units are substantially horizontally mounted, the dust receptacle is substantially vertically mounted relative to at least one of the first and second dust-collecting units, and the first and second dust-collecting units are arranged in series so that the air discharged from the first dust-collecting unit enters the second dust-collecting unit.

Another embodiment of the present invention provides a dust-collecting apparatus of a vacuum cleaner. The dust-collecting apparatus of a vacuum cleaner includes first means for separating dust from air; second means for separating dust adapted to be disposed substantially horizontally relative to the first means for separating dust, the second means for separating dust being adapted to receive air from the first means for separating dust; and means for collecting the dust adapted to be disposed substantially vertically relative at least one of the first and the second means for separating dust.

The dust-collecting apparatus of a vacuum cleaner includes a first means for whirling air to separate dust from air; a second means for whirling air adapted to be disposed substantially horizontally relative to the first means for whirling air, the second means for whirling air being adapted to receive air from the first means for whirling air; and a means for collecting the dust adapted to be disposed substantially vertically relative at least one of the first and second means for whirling.

BRIEF DESCRIPTION OF THE DRAWINGS

The above and/or other aspects of the present invention will be more apparent by describing certain exemplary embodiments of the present invention with reference to the accompanying drawings, in which.

Throughout the drawings, the same reference numerals will be understood to refer to the same elements, features, and structures.

DETAILED DESCRIPTION OF THE EXEMPLARY EMBODIMENTS

Hereinafter, a dust-collecting apparatus of a vacuum cleaner according to exemplary embodiments of the present invention will be described in detail with reference to the accompanying drawings.

Figure 1:
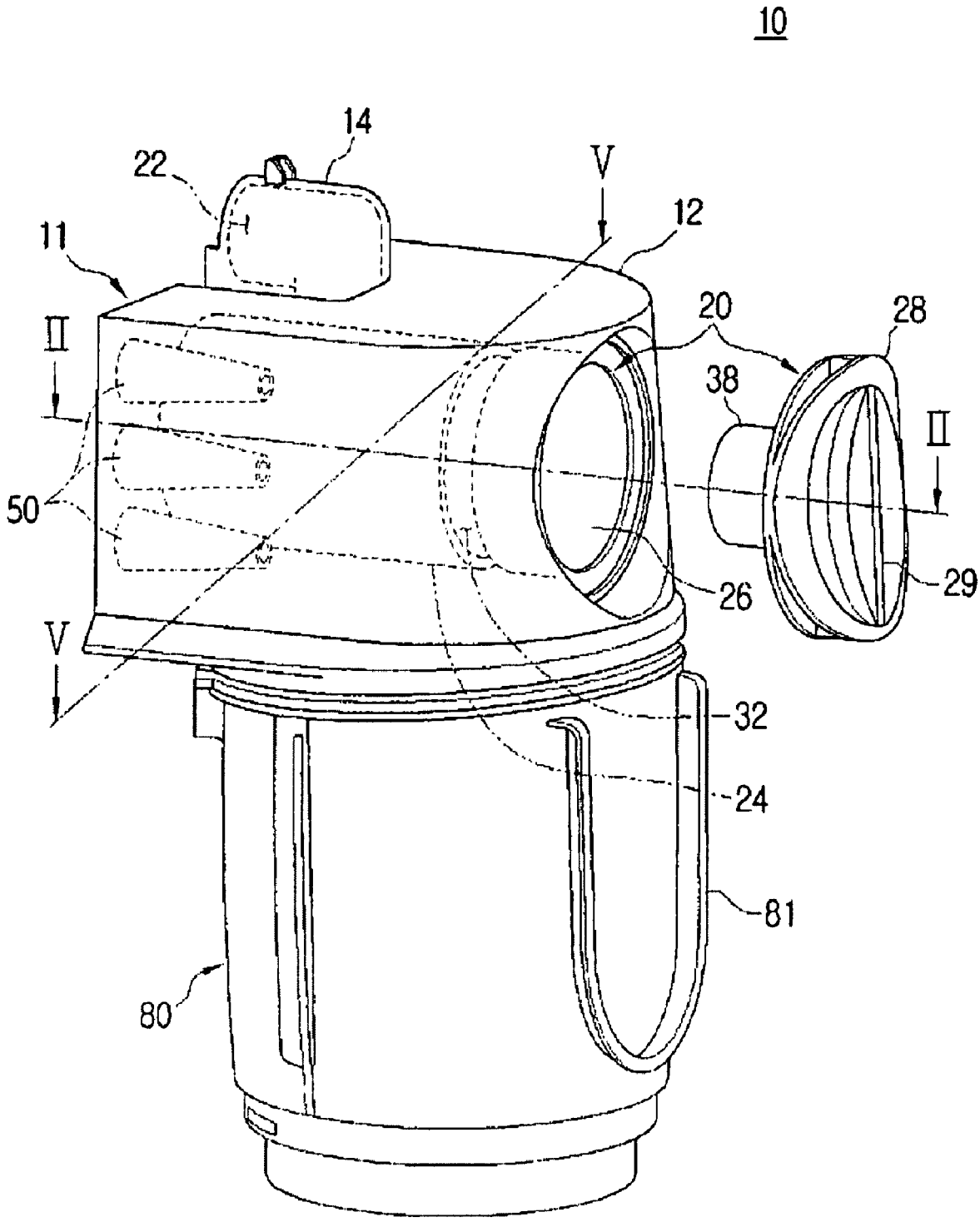
FIG. 1 is a perspective view illustrating a dust-collecting apparatus of a vacuum cleaner, according to an embodiment of the present invention.

Referring to FIG. 1, a dust-collecting apparatus 10 may include a dust-collecting part 11 and a dust receptacle 80. The dust-collecting part 11 may draw in air laden with dust and separates the dust from the air. The dust receptacle 80 may temporarily store the dust separated by the dust-collecting part 11. "Dust" herein refers generally to dirt, dust, fine dust particles or the like, which are usually separated when cleaning a home, office, factory or other place. The dust-collecting part 11 and dust receptacle 80 can be attached to or separated from each other. As shown in FIG. 1, the dust receptacle 80 can be joined to a bottom end of the dust-collecting part 11 while cleaning and can be separated from the dust-collecting part 11 when dumping the dust.

The dust-collecting part 11 may include a first dust-collecting unit 20, a second dust-collecting unit 50, and a dust-collecting casing 12. The first and second dust-collecting units 20 and 50 may be arranged in series so that air can flow sequentially from the first dust-collecting unit 20 to the second dust-collecting unit 50. Additionally, the first and second dust-collecting units 20 and 50 may be cyclone dust-collecting units which swirl dust-laden air and separate dust from the air.

An air inflow pipe 14 may project into an upper part of the dust-collecting casing 12. The air inflow pipe 14 may be installed tangentially to the cylindrical body 24, and accordingly the air can be drawn tangentially into the cylindrical body 24. An air inlet 22 may be formed in the air inflow pipe 14. A first opening 26 is formed on one side of the cylindrical body 24.

An access member 28 is mounted on one side of the cylindrical body 24 so that it may be separated from the cylindrical body 24. The access member 28 may include a grip 29. If a user desires to clean the first dust-collecting chamber 23 and the filter member 21 mounted in the first dust-collecting chamber 23, the user can clasp the grip 29 and remove the access member 28 from the cylindrical body 24.

Figure 2:
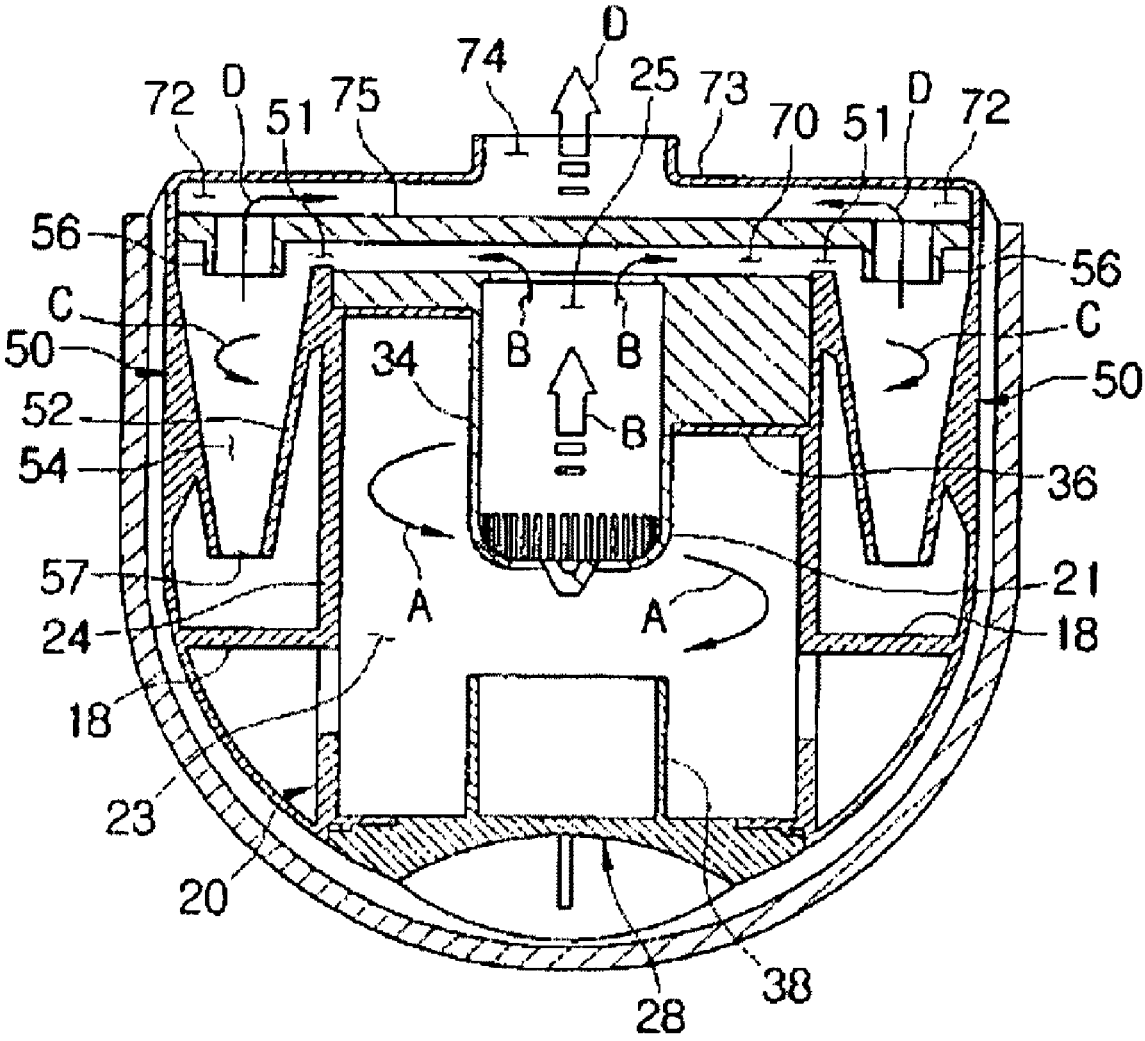
FIG. 2 is a sectional view of the dust-collecting apparatus taken along line II-II of FIG. 1.

The first dust-collecting unit 20 may be horizontally mounted. The first dust-collecting unit 20 may include a cylindrical body 24, and an access member 28. Referring to FIG. 2, the first dust-collecting unit 20 may also include a first guide member 34, a second guide member 36, a third guide member 38, and a filter member 21. The cylindrical body 24 may be horizontally mounted in the dust-collecting casing 12. An air outlet 25 is formed on the other side of the cylindrical body 24. The guide members 34, 36 and 38 may be mounted in the first dust-collecting chamber 23. The first guide member 34 may prevent the air from being dispersed from the center of rotation and may also guide the air passing through the filter member 21 to the air outlet 25. The filter member 21 may be formed in the shape of a pipe. The second guide member 36 may be a spiral member which guides the air drawn in through the air inlet 22 so that the air rotates in the first dust-collecting chamber 23 on an outer circumference of the first guide member 34. The third guide member 38 may project from the access member 28. The third guide member 38 may be arranged opposite to the first guide member 34 in the first dust-collecting chamber 23. Also, the third guide member 38 may be formed in the shape of a pipe in order to prevent the air from being dispersed from the center of rotation.

The second dust-collecting unit 50 may be horizontally mounted in the first dust-collecting unit 20 similar to the first dust-collecting unit 20. The second dust-collecting unit 20 may include bodies 52 and a discharge pipe 56. The bodies 52 of the second dust-collecting units 50 may be horizontally arranged in a conical shape. Three bodies 52 of the second dust-collecting units 50 may be arranged at the left side of the body 24 of the first dust-collecting unit 20. Another three bodies 52 of the second dust-collecting units 50 may be arranged at the right side of the body 24 of the first dust-collecting unit 20. The length of the body 52 of the second dust-collecting unit 50 may be approximately half the length of the body 24 of the first dust-collecting unit 20. Accordingly, a dust discharge port 57 of the second dust-collecting unit 50 may be spaced away from the dust discharge port 32 of the first dust-collecting unit 20 at a predetermined distance.

An air inlet 51 of the second dust-collecting unit 50 may be formed on one side of the body 52. The air inlet 51 may be in fluid communication with a first connection passage 70. A discharge pipe 56 may project into a second dust-collecting chamber 54. The second dust-collecting chamber 54 may be an internal space of the body 52. Also, the second dust-collecting chamber 54 may be integrally formed with a second partition 75. Each of the second dust-collecting units 50 may draw in air discharged by the first dust-collecting unit 20 and may separate fine dust particles from the air. The number and shape of the second dust-collecting units 50 may be variously configured.

The dust-collecting casing 12 may include a first partition 18 and the second partition 75 therein. The first partition 18 may divide the dust-collecting part 11 into a space in which the first dust-collecting unit 20 may be mounted and a space in which the second dust-collecting unit 50 may be mounted. The first partition 18 may have an "L" shape (shown in FIG. 3) so as to be connected to an inner circumference of the dust-collecting casing 12 and the outer circumference of the body 24 of the first dust-collecting unit 20. Accordingly, the first partition 18 may prevent mixing of dust discharged by the first dust-collecting unit 20 and dust separated by the second dust-collecting unit 50. The second partition 75 may be integrally formed with the discharge pipe 56 of the second dust-collecting unit 50. The second partition 75 may be connected to one side of the body 24 of the first dust-collecting unit 20 and the body 52 of the second dust-collecting unit 50. Therefore, the first connection passage 70 may be formed between the second partition 75 and the body 24 of the first dust-collecting unit 20. A second connection passage 72 may be formed between the second partition 75 and an outer wall 73 of the dust-collecting casing 12. The second connection passage 72 may be connected to a second opening 74 provided in the outer wall 73 of the dust-collecting casing 12.

Figure 3:
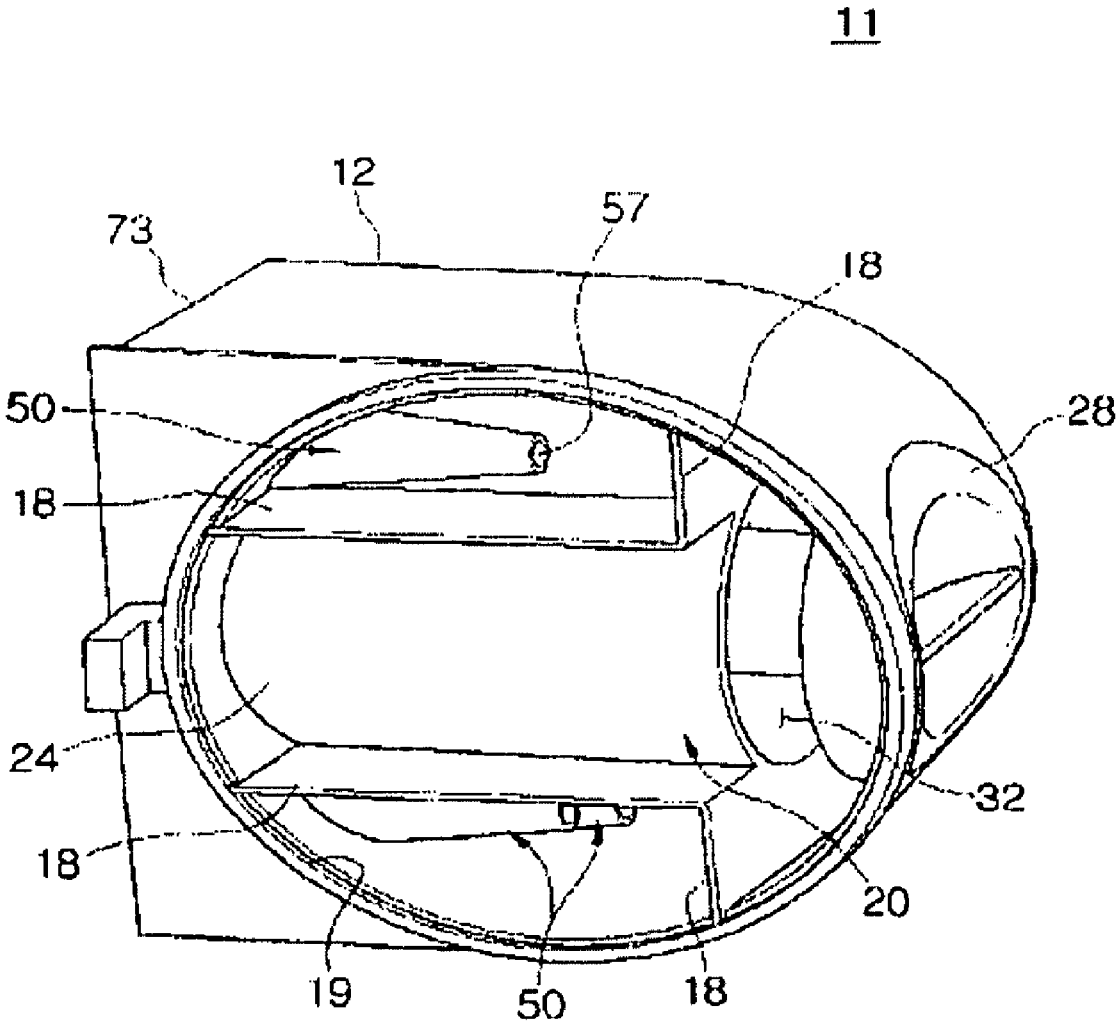
FIG. 3 is a perspective view of a dust-collecting part of the dust-collecting apparatus illustrated in FIG. 1.

Referring to FIG. 3, a dust discharge-port 32 may be disposed substantially around the circumference of the body 24 of the first dust-collecting unit 20. Accordingly, the dust separated from the first dust-collecting chamber 23 may fall into the dust receptacle 80. Alternatively, the dust discharge port 32 may be formed around only a portion of the circumference of the body 24.

The dust-collecting casing 12 may enclose the first dust-collecting unit 20 and the second dust-collecting unit 50. The dust-collecting casing 12 may be connected to or separated from the dust receptacle 80. A round case opening 19 having a cut interior may be formed on a bottom surface of the dust-collecting casing 12.

Figure 4:
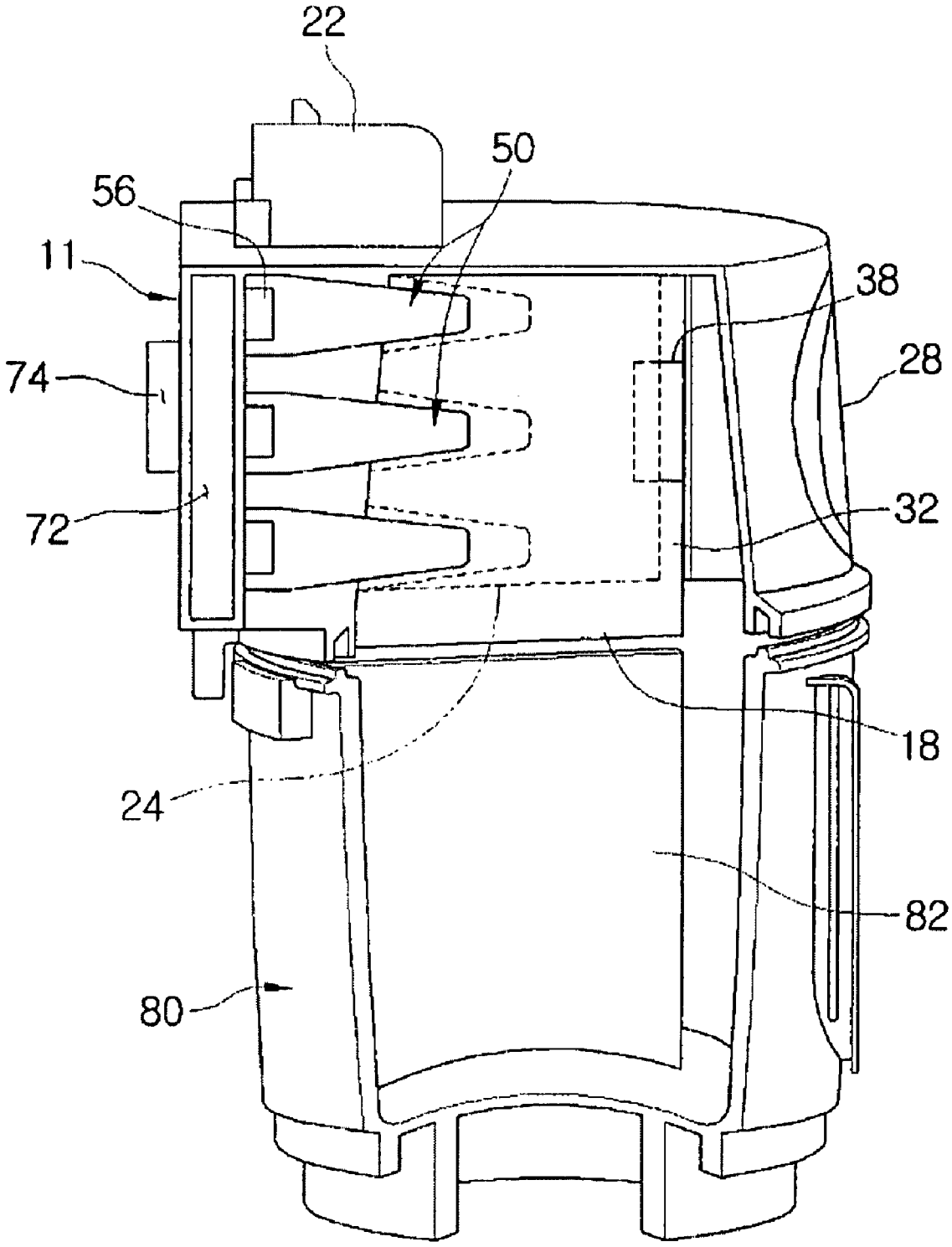
FIG. 4 is a partial sectional view of the dust-collecting apparatus illustrated in FIG. 1.
Figure 5:
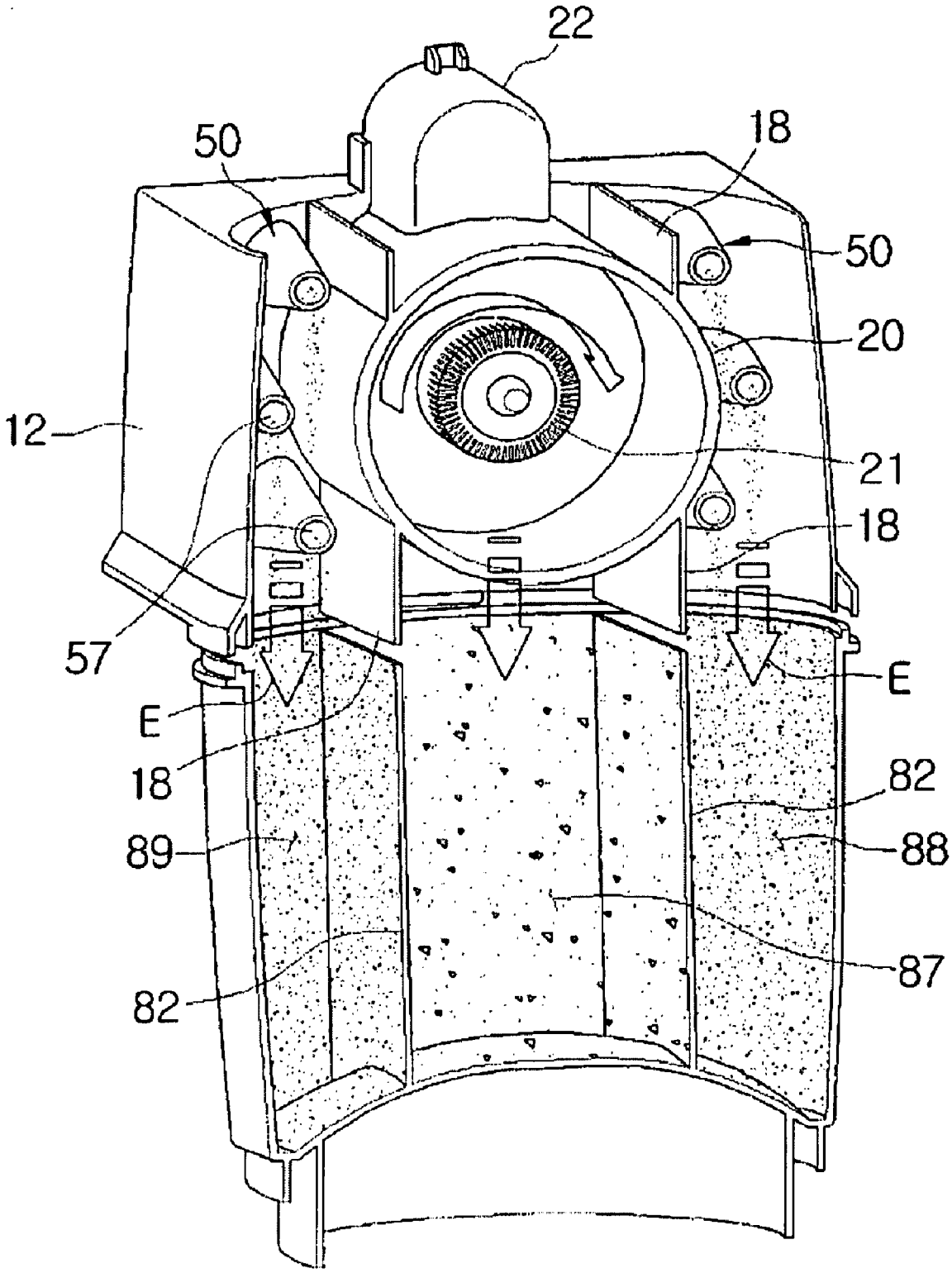
FIG. 5 is a sectional view of a first dust-collecting unit and a second dust-collecting unit of the dust-collecting apparatus taken along line V-V of FIG. 1.

Referring to FIG. 4, the dust receptacle 80 may have a cylindrical shape. The dust receptacle 80 may include a third partition 82 therein. Referring to FIG. 5, the third partition 82 may divide an internal space of the dust receptacle 80 into chambers 87, 88, and 89 so that dust dropping from the first dust-collecting unit 20 and dust dropping from the second dust-collecting unit 50 can be stored separately. For example, a plurality of third partitions 82 may divide the internal space of the dust receptacle 80 into a first chamber 87, a second chamber 88 and a third chamber 89.

Hereinafter, a process for separating and collecting dust according to exemplary embodiments of the present invention will be described in detail with reference to FIGS. 1 to 5. In this process, air laden with dust may be drawn in the first dust-collecting chamber 23 (shown in FIG. 2) through the air inflow pipe 14 (shown in FIG. 1). Large dust particles may be separated from the air while the air swirls along the guide members 34, 36 and 38, as indicated by arrow A in FIG. 2. The separated dust may fall into the first chamber 87 of the dust receptacle 80 through the dust discharge port 32, as shown in FIG. 5. The air may then pass through the filter member 21 to be dispersed into the second dust-collecting chambers 50 through the air outlet 25 and first connection passage 70, as indicated by arrow B in FIG. 2. Fine dust particles may be discharged through the dust discharge port 57 while the air swirls from the second dust-collecting chambers 50, as indicated by arrow C in FIG. 2. The discharged dust may fall into the second and third chambers 88 and 89 of the dust receptacle 80, as indicated by arrow E in FIG. 5. The partitions 18 (shown in FIG. 5), 75 (shown in FIG. 2) and 82 (shown in FIG. 5) prevent mixture of the dust discharged from the first and second dust-collecting chambers 23 and 54 (shown in FIG. 2). Thus, the dust particles can be stored separately in the dust receptacle 80 (shown in FIG. 4). The air may then be discharged through the second dust-collecting chamber 54 to the outside of the dust-collecting apparatus 10 through the second connection passage 72 and second opening 74, as indicated by arrow D in FIG. 2.

In the dust-collecting apparatus of the vacuum cleaner according to the exemplary embodiment of the present invention, the first dust-collecting unit and the second dust-collecting unit can be horizontally mounted, while the dust receptacle can be vertically mounted to prevent the dust collected in the dust receptacle from flowing back along the airflow. Additionally, the dust can be sequentially separated several times in two dust-collecting units which can be connected in series, and thus the dust-separating efficiency can be improved.

Furthermore, in the dust-collecting apparatus of the vacuum cleaner according to the exemplary embodiment of the present invention, the first dust-collecting unit can be disposed close to the second dust-collecting unit within the dust-collecting casing. Therefore, the dust-collecting apparatus can have a compact size. Also, the second dust-collecting unit can be horizontally mounted around the first dust-collecting unit to prolong the time until dumping of the dust in the dust receptacle is required.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A dust-collecting apparatus of a vacuum cleaner, comprising:

a first dust-collecting unit which rotates air laden with dust and separates the dust from the air;

a plurality of second dust-collecting units mounted around the first dust-collecting unit; and a dust receptacle which stores the dust separated by the first and the second dust-collecting units, the dust receptacle being mounted on a lower part of both the first and the second dust-collecting units, wherein the first dust-collecting unit and the plurality of second dust-collecting units are substantially horizontally mounted, the dust receptacle is substantially vertically mounted relative to at least one of the first and second dust-collecting units, and the first and second dust-collecting units are arranged in series so that the air discharged from the first dust-collecting unit enters the second dust-collecting unit.

2. The apparatus as claimed in claim 1, wherein the first and second dust-collecting units are cyclone dust-collecting units which swirl dust-laden air and separate dust from the air.

3. The apparatus as claimed in claim 2, wherein the first dust-collecting unit has a cylindrical shape, and the second dust-collecting unit has a conical shape.

4. The apparatus as claimed in claim 2, further comprising a dust-collecting casing which encloses the first and second dust-collecting units.

5. The apparatus as claimed in claim 4, wherein the dust-collecting casing comprises a case opening on a bottom surface thereof, and the dust receptacle is detachably connected to the bottom surface of the dust-collecting casing.

6. The apparatus as claimed in claim 5, wherein an air inlet, an air inflow pipe, and a dust discharge port are formed in the first dust-collecting unit, and the first dust-collecting unit comprises:

a cylindrical body in which a first dust-collecting chamber is formed; and an openable closure member which is detachably mounted at one end of the cylindrical body, the openable closure member being capable of opening or closing one side of the first dust-collecting chamber.

7. The apparatus as claimed in claim 6, wherein the air inlet is formed on a tangent to the cylindrical body, and the dust discharge port is formed around a circumference of the cylindrical body.

8. The apparatus as claimed in claim 6, further comprising in the first dust-collecting chamber at least one guide member which guides the rotation of the air.

9. The apparatus as claimed in claim 5, wherein the dust-collecting casing comprises at least one partition which allows the first dust-collecting unit and the second dust-collecting unit to be spatially divided.

10. The apparatus as claimed in claim 9, wherein the dust receptacle comprises partitions which divide an internal space of the dust receptacle into spaces which store dust separated by the first and the second dust-collecting units.

11. A dust-collecting apparatus of a vacuum cleaner, comprising:

first means for separating dust from air;

a plurality of second means for separating dust adapted to be disposed substantially horizontally around the first means for separating dust, the second means for separating dust being adapted to receive air from the first means for separating dust; and means for collecting the dust, adapted to be disposed substantially vertically relative to the first means for separating dust and the plurality of second means for separating dust.

12. The dust-collecting apparatus of claim 11, wherein the first means for separating dust comprises:

first means for collecting dust;

means for accessing the first means for collecting dust adapted to be disposed at the first means for collecting dust;

means for receiving air adapted to be in fluid communication with the first means for collecting dust; and means for discharging dust adapted to be in fluid communication with the first means for collecting dust.

* * * * *